United States Patent [19]

Gorokhovsky et al.

[11] Patent Number: 4,644,771

[45] Date of Patent: Feb. 24, 1987

[54] MILL FOR HOT ROLLING OF BEVEL GEARS

[75] Inventors: Alexandr M. Gorokhovsky; Leonid F. Fomichev, both of Moscow, U.S.S.R.

[73] Assignee: Nauchno-Issledovatelsky Institut Tekhnologii Avtomobilnoi Promyshlennosti Niiavtoprom, Moscow, U.S.S.R.

[21] Appl. No.: 745,491

[22] Filed: Jun. 17, 1985

[51] Int. Cl.[4] ..... B21B 27/06; B21H 5/04

[52] U.S. Cl. ..... 72/69; 72/342; 72/125

[58] Field of Search ..... 72/69, 84, 85, 101, 72/102, 105, 342, 13, 125; 219/10.59

[56] References Cited

U.S. PATENT DOCUMENTS

| | | | |
|---|---|---|---|
| 3,525,842 | 8/1970 | Steinhoff et al. | 219/10.59 |
| 4,523,444 | 6/1985 | Fuchs, Jr. | 72/21 |

FOREIGN PATENT DOCUMENTS

| | | | |
|---|---|---|---|
| 1376879 | 12/1974 | United Kingdom | 72/102 |
| 275995 | 7/1970 | U.S.S.R. | 72/69 |
| 753521 | 8/1980 | U.S.S.R. | 72/342 |
| 925501 | 5/1982 | U.S.S.R. | 72/69 |

*Primary Examiner*—Lowell A. Larson

*Attorney, Agent, or Firm*—McAulay, Fields, Fisher, Goldstein & Nissen

[57] ABSTRACT

A mill for hot rolling of bevel gears comprising a stand, a gear blank spindle rotatably mounted in the stand, a gear blank clamping device having a hydraulic cylinder and arranged in the gear blank spindle, a tool spindle mounted in the stand with the possibility to rotate and to travel transversely to the axis of the gear blank spindle, a gear blank heating device having a drawing mechanism. Fitted on the rod of the hydraulic cylinder of the driving mechanism of the gear blank heat device is a stop member brought into immediate contact with a cam. The mill also incorporates a tie-rod articulated to the cam and a two-arm lever having its one arm articulated to the tie-rod and the other one to the rod of the hydraulic cylinder of the gear blank clamping device.

5 Claims, 3 Drawing Figures

MILL FOR HOT ROLLING OF BEVEL GEARS

FIELD OF THE INVENTION

This invention relates to metal pressure working, and, in particular, to mills for hot rolling of bevel gears.

The mill for hot rolling of bevel gears according to the invention can be used for mass production in automotive, tractor and agricultural machinery manufacturing industries.

BACKGROUND OF THE INVENTION

Known in the art is a mill for hot rolling of bevel gears (cf., for example, USSR Inventor's Certificate No. 753,521 Cl. B 21 H 5/04, 1977), comprising a stand, a gear blank spindle rotatably mounted in the stand, a tool spindle rotatably mounted in the stand so that it can move transversely to the axis of the gear blank spindle.

The mill is also provided with a device for heating the gear blank, which comprise a platform mounted for parallel and perpendicular movement relative to the axis of the gear blank spindle under the action of hydraulic cylinders, a transformer and a high frequency current inductor mounted on the platform. Mounted in the gear blank spindle is a device for clamping the gear blank.

One of the important conditions for successful rolling of bevel gears is stable and uniform heating of the gear blank being treated prior to the rolling operation. To ensure stable and uniform heating of the gear blank, it is necessary that a gap of a preset size be maintained between the gear blank and the h.f. current inductor incorporated in the gear blank heating device. The gear blank used is a forged stock machined over datum surfaces, that is, over its end and central opening. In the given case, the gap between the gear blank and the h.f. current inductor remains permanent owing to the dimensional accuracy of the datum surfaces. However, preliminary machining of the datum surfaces of the gear blank brings down the economic efficiency of the mill by reason of the waste of metal unavoidably lost in shavings during machining.

There is also known a mill for hot rolling of bevel gears (cf. for example, USSR Inventor's Certificate No. 925,501 Cl. B21 H 5/04, 1980), which comprises a stand, a gear blank spindle mounted rotatably in the stand, a tool spindle mounted in the stand with the possibility to rotate and move at an angle to the gear blank spindle. The mill is also provided with a gear blank heating device which includes a platform capable of moving in parallel with and transversely to the axis of the gear blank spindle by means of hydraulic cylinders, a transformer and a h.f. current inductor mounted on the platform. Placed in the gear blank spindle is a gear blank clamping device having a chuck and a hydraulic cylinder. The clamping device interacts with a stop member provided to limit the movement of the h.f. current inductor when travelling in parallel with the axis of the gear blank spindle in the direction of the gear blank. Thus, the stop member is used in the known mill for maintaining the gap of a preset size between the gear blank and the h.f. current inductor irrespective of the height of the gear blank portion being clamped, which may vary in the hot-forged blanks over the range of several millimeters.

The prior-art mill for hot rolling of bevel gears makes it possible to hot roll bevel gear blanks in as-forged condition without premachining of datum surfaces.

However, in the above-described mill for hot rolling of bevel gears the stop member is cantilivered directly on the h.f. current inductor and interacts during heating with the chuck of the clamping device, rotating together with the gear blank. With such arrangement of the stop member, the platform mounting the gear blank heating device is subjected to the action of the bending moment, while the stop member wear increases because of its friction with the rotating chuck incorporated in the gear blank clamping device. By reason of unfavorable operating conditions, the stop member and the h.f. current inductor very soon become unserviceable, the stability of heating of gear blanks is upset, and the operating reliability of the mill for hot rolling of bevel gears is impared.

SUMMARY OF THE INVENTION

It is an object of the present invention to improve the operating reliability of a mill for hot rolling of bevel gears.

This object is attained in a mill for hot rolling of bevel gears, which comprises a stand, a gear blank spindle mounted for rotation in the stand, a gear blank clamping device having a hydraulic cylinder and mounted in the gear blank spindle, a tool spindle mounted rotatably in the stand movable at an angle to the axis of the gear blank spindle, a gear blank heating device including a platform mounted to move in parallel with the axis of the work-piece spindle by means of a hydraulic cylinder and transversely to the axis of the gear blank spindle by means of another hydraulic cylinder, a transformer and a h.f. current inductor mounted on the platform, as well as a stop member interacting with the gear blank spindle and adapted to limit the movement of the inductor of the gear blank heating device when travelling in parallel with the axis of the gear blank spindle in the direction of the gear blank, wherein, according to the invention, the stop member is positioned on the rod of the hydraulic cylinder used for moving the platform in parallel with the axis of the gear blank spindle, and there are additionally provided a cam mounted on the stand for movement relative to the stop member and brought in immediate contact therewith when the platform in caused to travel in the direction of the gear blank, a tie-rod articulated to the cam, and a two-arm lever mounted in the stand for turning in the plane passing through the axis of the gear blank spindle and through that of the hydraulic cylinder for moving the platform of the gear blank heating device in parallel with the axis of the gear blank spindle, with one arm of said lever being articulated to the tie-rod and the other to the rod of the hydraulic cylinder used for actuating the gear blank clamping device.

To reduce contact stresses at the place of interaction of the cam with the stop member, the cam is preferably made in the form of a wedge mounted on the stand for movement transversely to the axis of the gear blank spindle.

In order to improve operating reliability of the mill and to facilitate its maintenance, the gear blank clamping device is preferably provided with a chuck fixed on the gear blank spindle and, arranged inside the gear blank spindle and coaxially therewith, a first tie-rod with ball-bearings, connected with the chuck and spring-biased toward the gear blank, a second tie-rod connected with the ball-bearings of the first tie-rod, and a pin rigidly fixed in the second tie-rod, a second wedge mounted in the stand for interaction with the pin and for movement transversely to the gear blank spindle, and a hydraulic cylinder having its body fixed in the stand and its rod articulated to the second wedge and to the two-arm lever and capable of traveling in the direction perpendicular to the axis of the gear blank spindle.

The mill according to the invention for hot rolling of bevel gears makes it possible to substantially improve operating reliability.

BRIEF DESCRIPTION OF THE DRAWINGS

The invention will be further described, by way of example, with reference to the accompanying drawings, wherein.

DETAILED DESCRIPTION OF THE INVENTION

Figure 1:
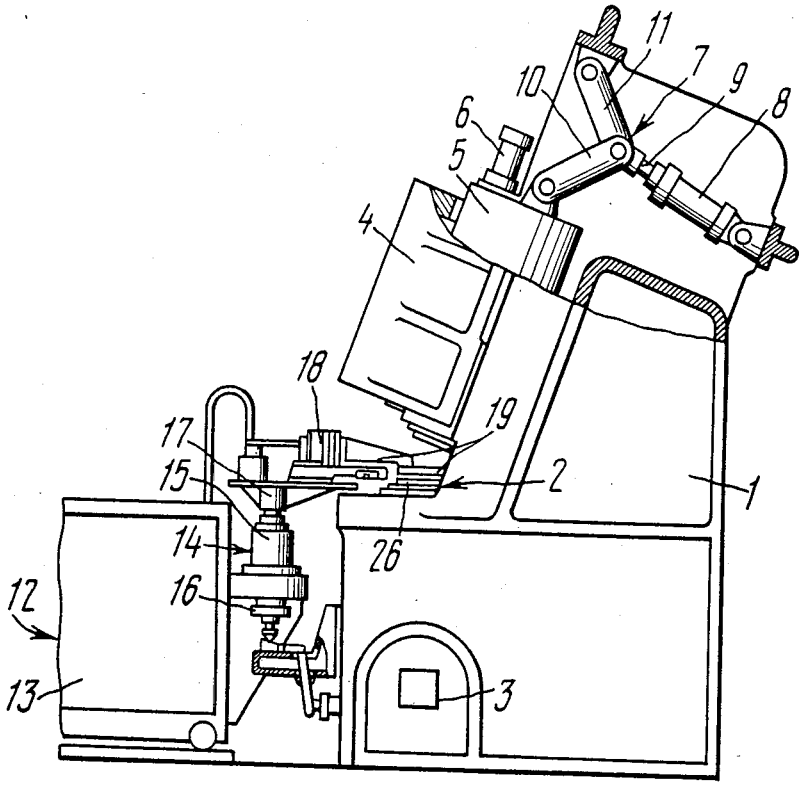
FIG. 1 is a general view of a mill for hot rolling of bevel gears according to the invention.

Referring now to the above drawings and to FIG. 1 in particular, there is shown therein a mill for hot rolling of bevel gears, which comprises a stand 1, a gear blank spindle 2 mounted in the stand 1 and a drive 3 for rotating the gear blank spindle 2. Fixed on the stand 1 is a guide 4. Placed in the guide 4 at an angle to the gear blank spindle 2 is a tool spindle 5 on which there is mounted a drive 6 for axially rotating the tool spindle 5. The mill also has a drive 7 for moving the tool spindle 5, including a hydraulic cylinder 8 pivotably attached to the stand 1 and having its rod 9 pivotally attached to levers 10 and 11. The lever 10 is pivotally attached to the gear blank spindle 5. The lever 11 is articulated to the stand 1.

The mill also comprises a device 12 for heating the gear blank including a frame 13 and a driving mechanism 14 mounted on the frame 13 and having a hydraulic cylinder 15 and a hydraulic cylinder 16, a platform 17 mounted on the driving mechanism 14, a transformer 18 and a r.f. current inductor 19 mounted on the platform 17.

Figure 2:
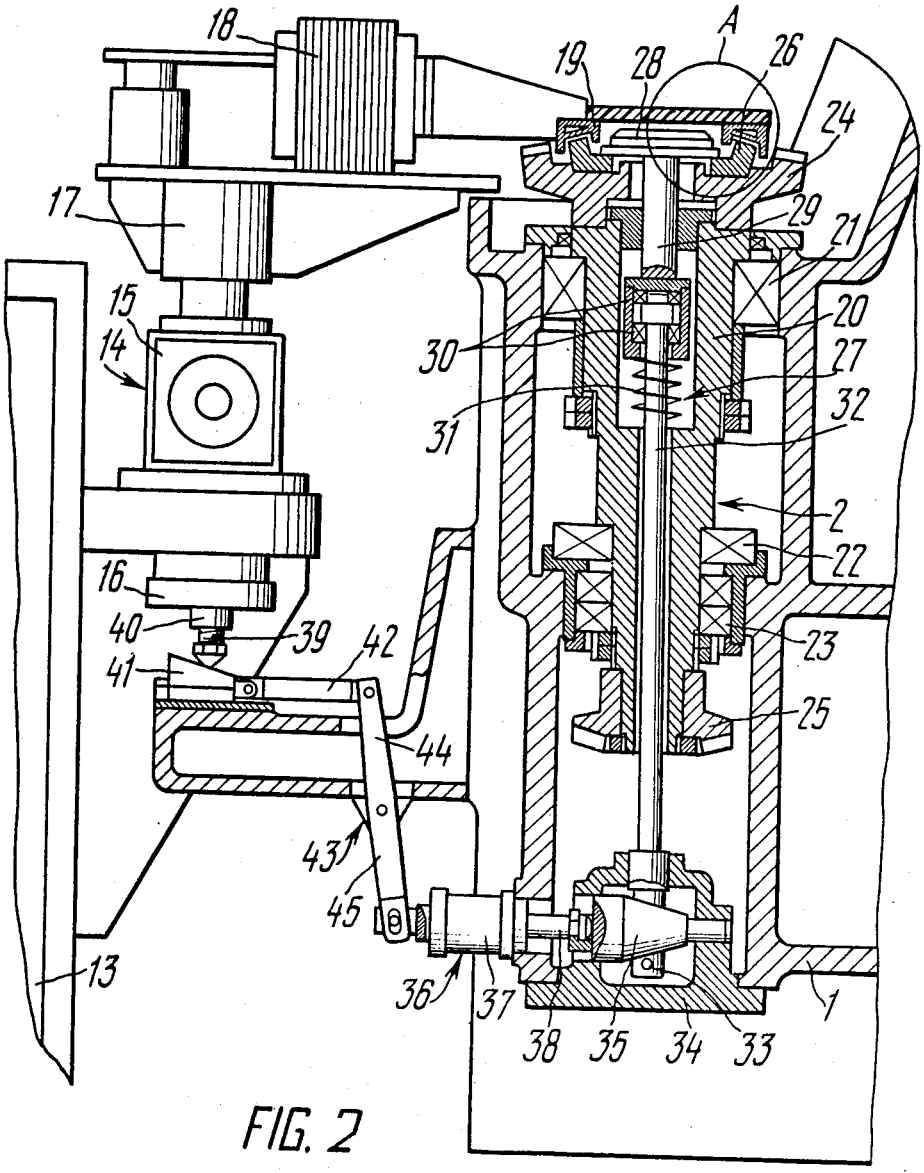
FIG. 2 is a longitudinal sectional view of a gear blank spindle, a platform with a transformer and a r.f. current inductor, according to the invention.

The gear blank spindle 2 comprises a shaft 20 (FIG. 2) with ball-bearings 21, 22 and 23 mounted thereon. Fixed on the shaft 20 are a synchronizer 24 and a pinion 25 of the drive 3. Placed on the synchronizer 24 is a gear blank 26.

The mill is also provided with a gear blank clamping device 27 including a chuck 28 carried on the synchronizer 24, a first tie-rod 29 accommodated within the shaft 20 in coaxial arrangement therewith and connected with the chuck 28, ball-bearings 30 placed in the interior space of the tie-rod 29, a spring 31 positioned between the tie-rod 29 and the shaft 20, a second tie-rod 32 connected with the ball-bearings 30.

The clamping device 27 also comprises a pin 33 fixed in the tie-rod 32, a cup 34 secured in the stand 1, a wedge 35 placed in the cup 34 for interaction with the pin 33. There is also provided a hydraulic cylinder 36 having its body fixed in the stand 1 and its rod 38 pivotally attached to the wedge 35.

In addition, there is provided a stop member 39 made in the form of a screw and placed on a rod 40 of the hydraulic cylinder 16. The mill comprises a cam pivotally attached to a tie-rod 42. A two-arm lever 43 is mounted in the stand 1 for turning in the plane extending through the axis of the gear blank spindle 2 and that of the hydraulic cylinder 16 for moving the platform 17 of the gear blank heating device 12 in parallel to the axis of the gear blank spindle 2. The two-arm lever 43 has its arm 44 articulated to the tie-rod 42 and its arm 45 to the other end of the rod 38 of the hydraulic cylinder 36.

The mill for hot rolling of bevel gears operates in the following manner.

Figure 3:
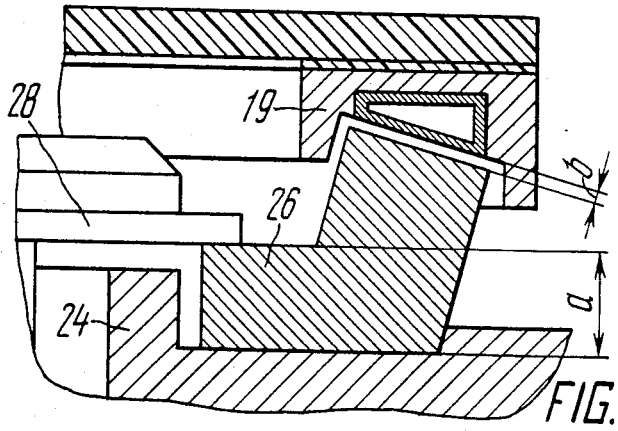
FIG. 3 is a longitudinal sectional view of a gear blank heating zone shown at A in FIG. 2.

First the gear blank 26 (FIGS. 2, 3) is fitted onto the spindle 2. When the rod 38 of the hydraulic cylinder 36 is moved toward the axis of the gear blank spindle 2, the wedge 35 is actuated to move the pin 33, together with the tie-rods 32 and 29 and the chuck 28, toward the gear blank 26. As this happens, the gear blank 26 is clamped on the spindle 2 and the spring 31 is compressed.

Simultaneously, the rod 38 of the hydraulic cylinder 36 is actuated to turn the lever 43 which operates to move the tie-rod 42 and the cam 41. The distance of travel of the cam 41 is directly proportional to the distance of travel of the chuck 28, which depends on the height of the portion "a" (FIG. 3) of the gear blank 26, clamped by the chuck 28.

Once the gear blank 26 is clamped, the platform 17 and the inductor 19 are successively moved by means of the hydraulic cylinders 15 and 16 (FIG. 2) to the place where the gear blank 26 is subjected to heating. At the same time, the stop member 39 is brought into intimate contact with the cam 41, and the drive 3 for rotating the spindle 2 and the inductor 19 are energized.

Since the distance of travel of the cam 41 depends on the height of the portion "a" (FIG. 3) of the gear blank 26, clamped by the chuck 28, the distance of travel of the inductor 19 will also depend on the height of this portion of the work-piece 26. Consequently, the size of the gap between the inductor 19 and the gear blank 26 will remain unchanged and independent of the height of the portion "a" of the gear blank 26, clamped by the chuck 28. In this way it becomes possible to achieve stable heating of each gear blank 26.

After heating the gear blank 26, the inductor 19 is backed away and the spindle 5, rotated by the drive 6 (FIG. 1), is brought to the gear blank 26 to perform hot rolling of bevel gear teeth.

With the stop member 39 placed on the rod 40 of the hydraulic cylinder 16, the platform 17 with the inductor 19 is completely freed from the outside load. When the stop member 39 is placed outside of the working area (the area of rolling), it is not in working contact with the rotating chuck 28 but rather is into contact with the now immobile cam 41. All these factors ensure improved operating reliability of the mill.

From the above it follows that with the mill of the invention it becomes possible to successfully perform hot rolling of bevel gears by using gear blanks in as forged condition and avoiding preliminary machining of datum surfaces thereof, which permits a substantial gain in the economy of metal.

What is claimed is:

1. A mill for hot rolling of bevel gears, comprising:

a stand;

a gear blank spindle mounted for rotation in said stand;

a device for clamping a gear blank to said gear blank spindle, said device having a first hydraulic cylinder and arranged in said gear blank spindle;

a tool spindle mounted in said stand and means for rotating and moving said tool spindle at an angle to the axis of said gear blank spindle;

a device for heating a gear blank, said heating device including a transformer, a r.f. current inductor, a second hydraulic cylinder, a thrid hydraulic cylinder and a platform mounted for travelling in a direction parallel with the axis of said gear blank spindle by means of the second hydraulic cylinder and transversely to the axis of said gear blank spindle by means of the third hydraulic cylinder, said transformer being mounted on the platform, and said r.f. current inductor being mounted on the platform;

a stop member fitted on the rod of said second hydraulic cylinder for interaction with said clampaing device and adapted to limit the movement of said inductor in the direction parallel with the axis of said gear blank spindle toward said gear blank;

a cam mounted on said stand for movement relative to said stop member and brought into immediate contact therewith when said platform is moved in a direction parallel with the axis of said gear blank spindle;

a tie-rod pivotally attached to said cam; and a two-arm lever having a first and second arm and mounted in said stand to turn in a plane passing through the axis of said gear blank spindle and through that of said second hydraulic cylinder, said two-arm lever having its first arm pivotally attached to said tie-rod and its second arm to the rod of said first hydraulic cylinder incorporated in said clamping device.

2. A mill as claimed in claim 1, wherein said cam is made in the form of a first wedge mounted on said stand to travel at a right angle to the axis of said gear blank spindle.

3. A mill as claimed in claim 2, wherein said device for clamping a gear blank includes:

a chuck carried on the gear blank spindle:

a first tie-rod having ball-bearings and connected with said chuck and accommodated within said gear-blank spindle in coaxial arrangement therewith;

a second tie-rod connected with the ball-bearings and accommodated within said gear blank spindle in coaxial arrangement therewith;

a pin fixedly mounted in said second tie-rod and accommodated within said gear blank spindle in perpendicular arrangement therewith;

a second wedge mounted in said stand for interaction with said pin and permitted to move at a right angle to the axis of said gear blank spindle; and said first hydraulic cylinder having its body fixed in the stand and its rod articulated to said second wedge and to said second arm of said two-arm lever and permitted to travel transversely to the axis of the gear blank spindle.

4. A mill as claimed in claim 1, wherein said gear blank clamping device includes:

a chuck carried on said gear blank spindle, a first tie-rod having ball-bearings and connected with said chuck and accommodated within said gear blank spindle in coaxial arrangement therewith, a second tie-rod connected with said ball-bearings and accommodated within said gear blank spindle in coaxial arrangement therewith, a pin fixedly mounted in said second tie-rod in perpendicular arrangement therewith, a cam mounted in said stand for interaction with said pin and permitted to move at a right angle to the axis of said gear blank spindle, and a hydraulic cylinder having its body fixed in said stand and its rod articulated to said cam and to said two-arm lever and permitted to travel transversely to the axis of the gear blank spindle.

5. A mill as claimed in claim 4, wherein said cam is wedge-shaped and is movable at a right angle to the axis of said gear blank spindle.

* * * * *